US007427215B2

(12) United States Patent
Heckmann et al.

(10) Patent No.: US 7,427,215 B2
(45) Date of Patent: Sep. 23, 2008

(54) PLUG-IN CONNECTOR FOR GUIDING A CABLE THROUGH AN OPENING OF A SEPARATING WALL OF AN, IN PARTICULAR, MILITARY DEVICE

(75) Inventors: Andreas Heckmann, Fuldatal (DE); Peter Fiedler, Fuldatal-Simmershausen (DE); Roland Bühler, Heilbronn (DE)

(73) Assignee: Krauss-Maffei Wegmann GmbH & Co. (DE)

( * ) Notice: Subject to any disclaimer, the term of this patent is extended or adjusted under 35 U.S.C. 154(b) by 0 days.

(21) Appl. No.: 11/574,998

(22) PCT Filed: Aug. 26, 2005

(86) PCT No.: PCT/DE2005/001498

§ 371 (c)(1),
(2), (4) Date: Jun. 12, 2007

(87) PCT Pub. No.: WO2006/026954

PCT Pub. Date: Mar. 16, 2006

(65) Prior Publication Data

US 2008/0045072 A1 Feb. 21, 2008

(30) Foreign Application Priority Data

Sep. 9, 2004 (DE) ..... 20 2004 014 020 U

(51) Int. Cl.
*H01R 9/03* (2006.01)

(52) U.S. Cl. ..... 439/610; 439/931

(58) Field of Classification Search ..... 439/92, 439/95, 108, 607–610, 931, 939
See application file for complete search history.

(56) References Cited

U.S. PATENT DOCUMENTS 2,668,215 A * 2/1954 Duerkob ..... 337/195

(Continued)

FOREIGN PATENT DOCUMENTS

DE 80 05 658 8/1980

(Continued)

*Primary Examiner*—James Harvey
(74) *Attorney, Agent, or Firm*—Robert W. Becker; Robert Becker & Assoc.

(57) ABSTRACT

A plug connection for guiding a cable through an opening of a partition, comprising a device socket having a plug receiving portion, and a plug with an insertion body with a locking ring that cooperates with locking elements of the plug receiving portion. At least one cable adapter is connectable to the device socket or plug. A cadmium-free electrically conductive surface coating is provided on at least an inner or outer continuous surface of the electrically conductive components of the plug connection. The contact points between base bodies of the socket device and plug on the one hand, and base bodies of the respective cable adapter on the other hand, are embodied as interengaging teeth. The contact point between the base bodies of the device socket and the plug is produced by a ground ring on one of them and has resilient tongues that rest on the other one. Outwardly visible components, especially outer sides of the plug receiving portion, of the locking ring, and possibly of the coupling nuts of the cable adapters, are provided with a dull, cadmium-free surface that is resistant to environmental influences and is possibly electrically insulating.

16 Claims, 2 Drawing Sheets

U.S. PATENT DOCUMENTS 4,243,290 A * 1/1981 Williams ..... 439/610
4,399,318 A * 8/1983 Waters ..... 174/359
4,433,206 A * 2/1984 Lewis ..... 174/359
5,169,724 A 12/1992 Fogarty
5,882,226 A 3/1999 Bell et al.
6,123,563 A 9/2000 Johnson et al.
2008/0045072 A1 * 2/2008 Heckmann et al. ..... 439/374

FOREIGN PATENT DOCUMENTS

DE 43 07 728 9/1994
DE 299 05 566 9/2000
GB 2 127 234 4/1984

* cited by examiner

Fig.1
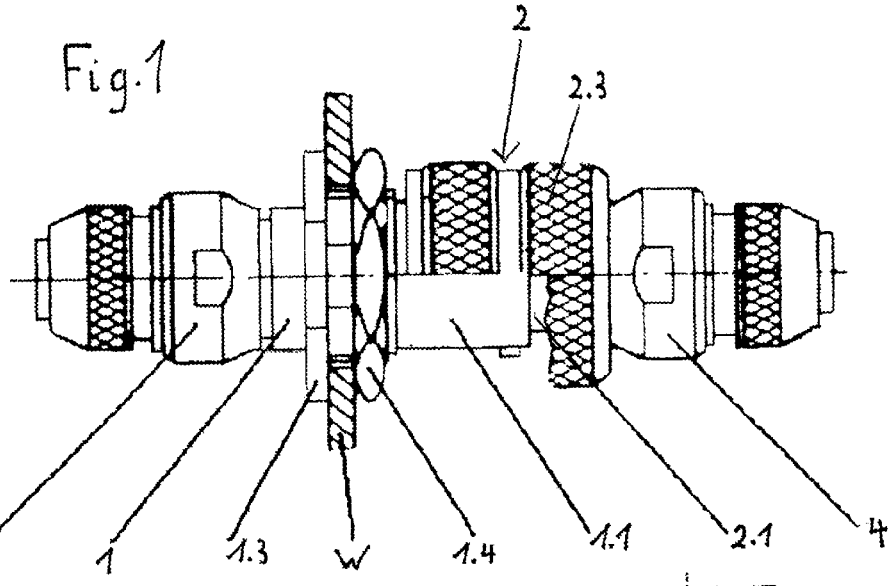
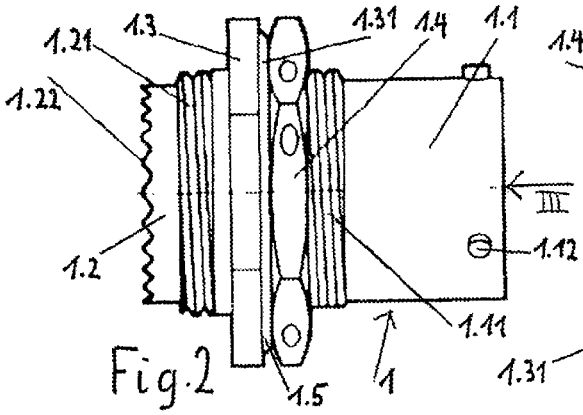
Fig.2
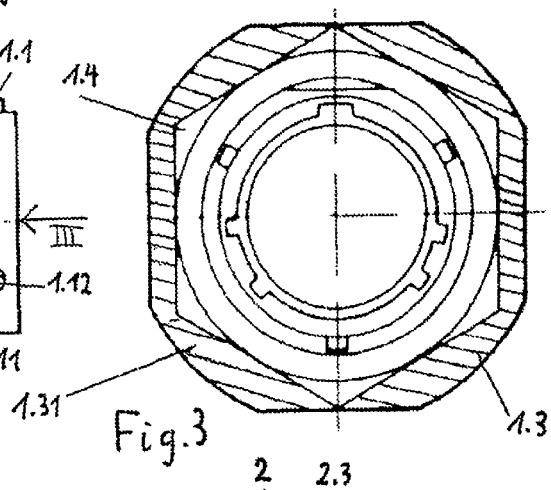
Fig.3
Fig.5
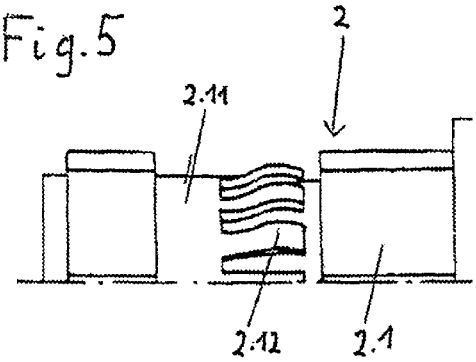
Fig.4
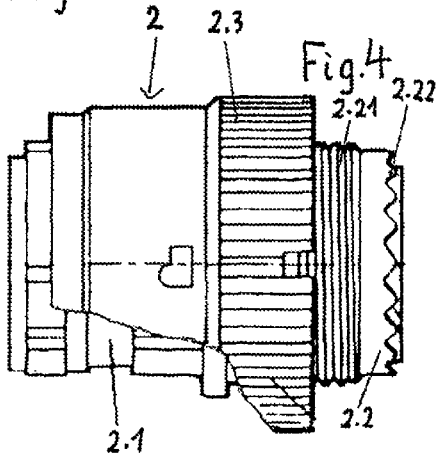

PLUG-IN CONNECTOR FOR GUIDING A CABLE THROUGH AN OPENING OF A SEPARATING WALL OF AN, IN PARTICULAR, MILITARY DEVICE

BACKGROUND OF THE INVENTION

The instant application should be granted the priority dates of Sep. 9, 2004, the filing date of the corresponding German patent application 20 2004 014 020.9 as well as Aug. 26, 2005, the filing date of the International patent application PCT/DE2005/001498.

The present invention relates to a plug-in connector or plug connection for guiding a cable through an opening of a separating wall or partition, especially of a military device.

Such plug connections are known in general. They should have the following characteristics, especially when used on military devices:

a) a good electromagnetic compatibility (EMV),
b) a good resistance to environmental influences, especially corrosion due to salt spray, as occurs during the firing of projectiles or rockets,
c) a dull, olive-colored surface of the outwardly visible surfaces, especially for camouflage reasons.

These conditions have up to now been fulfilled, among other ways, in that all surfaces of the components of the plug connection are provided with a nickel plating, over which a cadmium-containing layer is applied that subsequently is colored green. This layer built-up fulfills the aforementioned requirements with regard to the electromagnetic compatability, the protection against corrosion and the colorization.

Since cadmium-containing materials may present a health hazard, the requirement was set to use cadmium-free plug connections for military projects if possible.

It is an object of the present invention to embody a plug connection having the aforementioned features in such a way that all of the above mentioned conditions are fulfilled without the need for the surfaces of the components of the plug connection to contain cadmium-containing materials.

SUMMARY OF THE INVENTION

The realization of this object is effected pursuant to the invention with a device socket having a base body provided with a plug receiving portion that is adapted to be inserted through the partition opening and is delimited by a mounting flange, wherein the device socket is furthermore provided with a cable connector disposed on a side of the mounting flange remote from the plug receiver portion and provided with a thread for a threaded connection with the coupling nut of a cable adapter. The plug having a base body provided with an insertion body can be inserted into the device socket, wherein a locking ring is rotatably disposed on the insertion body and cooperates with locking elements disposed on the plug receiving portion of the device socket. The plug is furthermore provided with a cable connector having a thread for threaded connection with the coupling nut of a cable adapter. At least one cable adapter is adapted to be connected to the device socket and/or the plug for the connection of a cable that is provided with a shielding braiding, wherein the cable adapter has a base body through which the base body is adapted to be guided and on which the coupling nut is rotatably disposed. Each cable adapter has a connection end provided with securing means for the shielding braiding of the cable. A cadmium-free, electrically conductive surface coating is provided on at least an inner or outer continuous surface of: electrically conductive ones of the components of the plug connection, including the base bodies of the device socket and plug; at least a contact surface of the mounting flange relative to the partition; and possibly the base body of the cable adapter. To ensure a continuous, electrically conductive contact, the contact points between the base bodies of the device socket and the plug on the one hand, and the base bodies of the respective cable adapter on the other hand, are embodied as interengaging teeth. The contact point between the two base bodies of the device socket and of the plug is produced by a ground ring that is disposed on the plug or on the device socket and is provided with resilient tongues that respectively rest on an inner or outer surface of the other base body. The outwardly visible components of the plug connection, in particular the outer sides of the plug receiving portion of the device socket, of the locking ring of the plug, and possibly of the coupling nuts of the cable adapters, are provided with a dull, cadmium-free surface that is resistant to environmental influences and is possibly electrically insulating.

The present invention proceeds from the recognition that, in order to achieve a good electromagnetic compatability (EMV), it is not absolutely necessary to design all components of the plug connection electrically conductive or to provide them with an electrically conductive surface. Rather, it is sufficient if continuous electrically conductive surfaces that are in good contact with one another are provided along the plug connection. This does not, however, necessarily mean all outwardly visible surfaces. With the inventive plug connection, the components that are to be designed electrically conductive are predominantly found in the outwardly not visible portion of the plug connection, whereas many of the individual components that are outwardly visible are not relevant for the electrical conductivity.

Pursuant to features of the present invention, a very good continuous electrical conductivity is achieved in that the components of the plug connection that are to be designed electrically conductive are provided on at least an inner or outer continuous surface with a cadmium-free, electrically conductive surface coating, and to ensure a good electrical contact between these electrically conductive individual components, the contact points between the base bodies of the plug components and the base bodies of the cable adapters are embodied as interengaging teeth, and the contact point between the base bodies of the device socket and of the plug is produced by a ground ring that is connected with one of the base bodies and that is provided with resilient tongues that respectively rest against a surface of the other base body. Pursuant to another feature of the present invention, furthermore the individual components of the plug connection that have outwardly visible surfaces, and that do not necessarily have to have an electrical conductivity, are provided with a dull, cadmium-free surface that is resistant to environmental influences. This surface can be electrically insulating. These individual components, where no electrical conductivity is required, can also be made entirely of insulating material, for example of polymeric material.

Pursuant to a particularly advantageous embodiment of the inventive plug connection, the electrically conductive surface coating is comprised of nickel, and preferably of a nickel coating that is applied in several layers and is known by the designation "heavy nickel". However, other electrically conductive surface coatings can also be used, for example comprised of tin, zinc or copper.

The important thing when selecting the coating materials is not only their electrical conductivity and the resistance to corrosion, but also the position of the material in the electrochemical series.

The dull, cadmium surface that is resistant to environmental influences can also be embodied as an eloxidized metallic surface for individual components that are made of metal.

It has been shown that the inventive plug connection designed in this manner has an excellent electromagnetic compatability and a very good resistance to corrosion, and can be provided with a dull, especially olive-colored, surface on the outer surfaces without having to use cadmium-containing materials.

BRIEF DESCRIPTION OF THE DRAWINGS

One embodiment for a plug connection pursuant to the invention is described in greater detail subsequently with the aid of the accompanying drawings, in which:

FIG. 1 is a partially sectioned or broken-away side view of an assembled plug connection having cable adapters threaded thereon;

FIG. 2 is a side view of the device socket of the plug connection of FIG. 1;

FIG. 3 shows the device socket of FIG. 1 in a view taken in the direction of the arrow III in FIG. 2;

FIG. 4 is a partially broken-away side view of the plug of the plug connection of FIG. 1;

FIG. 5 is a schematic partial side view of the base body of the plug of FIG. 4 without the locking ring;

DESCRIPTION OF PREFERRED EMBODIMENTS

Figure 6:
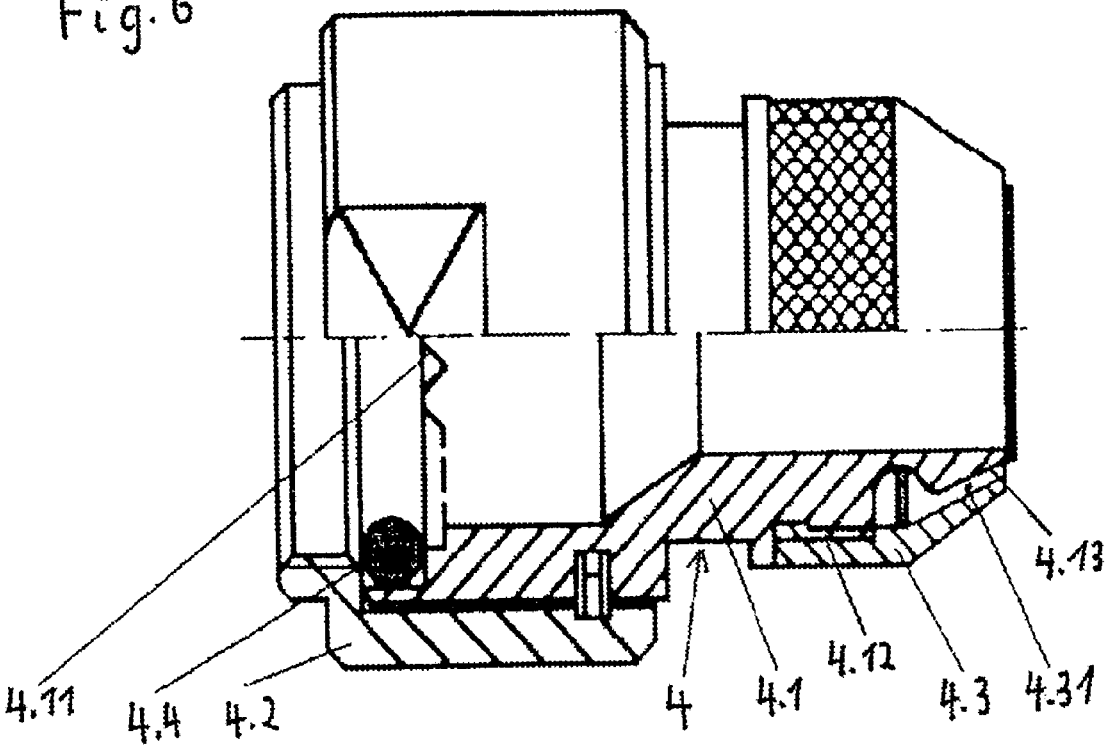
FIG. 6 is a partially sectioned side view, enlarged relative to FIG. 1, of a cable adapter that is adapted to be threaded onto the plug of FIG. 4.

The plug connection illustrated in the drawings includes a device socket 1 that, on a base body, is provided with a plug receiving portion 1.1 that can be inserted through an opening in a partition or separating wall W of a device, which is not otherwise illustrated. The plug receiving portion is delimited by a flange 1.3 and has an external thread 1.11. By threading a mounting or retaining nut 1.4 onto the external thread 1.11, the device socket can be mounted in the opening of the partition W in such a way that, as can be seen from FIG. 1, portions of the mounting wall W are clamped between the flange 1.3 and the retaining nut 1.4. A sealing member 1.5 is disposed on that side of the flange 1.3 that faces the mounting wall W in order to provide a seal at this location. Disposed on that side of the mounting flange 1.3 that faces away from the plug receiving portion 1.1 is a cable connector 1.2 that also has an external thread 1.21 for the threading on of the retention coupling nut of a cable adapter, which will be explained subsequently. The insertion portion 2.1 on the base body of a plug 2 can be inserted into the plug receiving portion 1.1. Rotatably disposed on the plug 2 is a locking ring 2.3 that cooperates with locking elements 1.12 on the plug receiving portion 1.1 in such a way that in the inserted state it is possible to lock the plug with the device socket. On that side facing away from the insertion portion 2.1, the plug has a cable connector 2.2 that is provided with an external thread 2.21 for the threading on of the retention coupling nut of a cable adapter, which will be explained subsequently.

In the embodiment illustrated in FIG. 1, cable adapters 3 and 4 are connected not only to the cable connector 1.2 of the device socket, but also to the cable connector 2.2 of the plug. In principle, these cable adapters have the same construction, and in FIG. 6 the cable adapter 4 that is connected to the plug 2 is illustrated in detail. This cable adapter has a base body 4.1 through which can be guided the non-illustrated cable and on which is rotatably disposed a retention coupling nut 4.2 that can be threaded onto the external thread 2.21 on the cable connector 2.2 of the plug 2. At the connection end for the cable, the base body 4.1 of the cable adapter 4 has an external thread 4.12 onto which can be threaded a clamping nut 4.3, which has an inner conical clamping surface 4.31 that is disposed across from an outer conical clamping surface 4.13 on the connection end of the base body 4.1 for the fixation of the non-illustrated shielding braiding of the cable between the clamping surfaces 4.31 and 4.13.

It is to be understood that other securing devices for the shielding braiding are also possible. For example, the shielding braiding can be secured to the cylindrical outer surface of the base body by means of a metal band or metal clamp.

Figure 7:
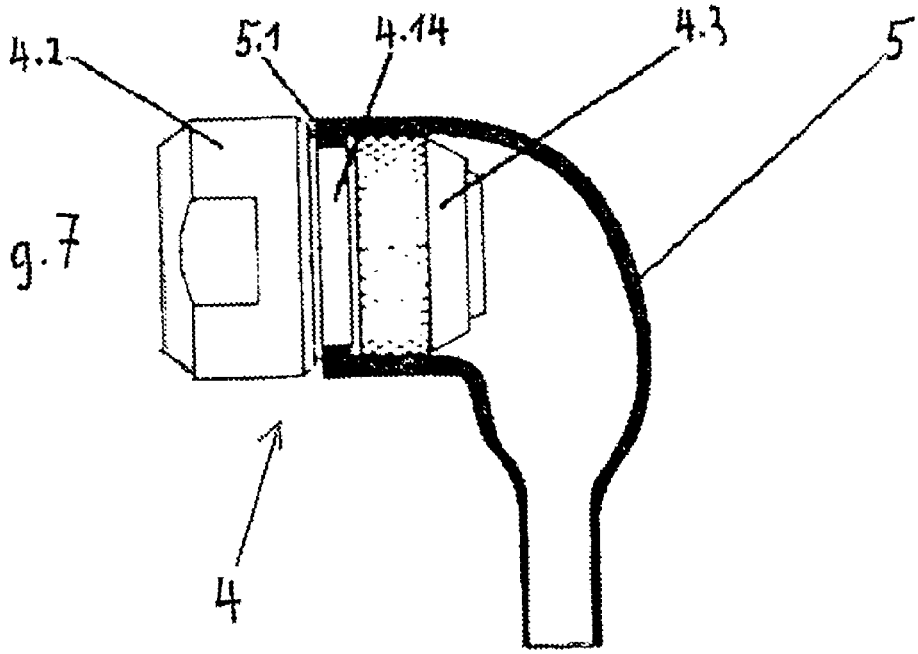
FIG. 7 shows the cable adapter of FIG. 6, reduced in size relative to FIG. 6, with a molded part disposed thereon.

A sealing ring 4.4 is disposed at that end of the base body 4.1 that faces the plug 2 for sealing this connection location relative to environmental influences. The connection end for the cable on the base body 4.1 of the cable adapter 4 is, in the final assembled state, as shown in FIG. 7, surrounded by the end of a molded part 5 that guides the cable and that on its end that faces the adapter is provided with a retaining lip 5.1 that engages in a receiving groove 4.14 on the base body 4.1 of the cable adapter 4.

The cable adapter 3 that can be placed upon the device socket 1 has the same construction.

To achieve a continuous electrically conductive connection over the length of the plug connection with regard to the electromagnetic compatability, in the illustrated embodiment the base body 1.1 of the device socket 1, the base body 2.1 of the plug 2, as well as the base bodies of the two cable adapters 3 and 4 and the contact surface 1.31 of the flange 1.3 of the device socket 1 are provided in a direction toward the partition W with a cadmium-free, electrically conductive surface coating of nickel (heavy nickel) applied in several layers. A heavy nickel surface is extraordinarily resistant to salt spray and is electrically very conductive yet shiny. The electrical contact between the base body 1.1 of the device socket 1 and the base body 2.1 of the plug 2 is effected via a ground ring 2.11 that is disposed on the plug and is provided with resilient tongues 2.12 that rest against the inner wall of the plug receiving portion 1.1 of the device socket (FIGS. 4 and 5).

The electrical contact between the cable connector 1.2 of the base body of the device socket 1, or the cable connector 2.2 of the base body of the plug 2, to the base bodies of the cable adapters 3 and 4 is effected via teeth 1.22 or 2.22 that are disposed about the peripheries of the base bodies of the device socket 1 or the plug 2, and which engage in corresponding teeth on the base bodies of the cable adapters 3 and 4, for example into the teeth 4.11 on the base body 4.1 of the cable adapter 4 (FIG. 6).

The outwardly visible back side of the mounting flange 1.3 on the device socket 1, as well as the outer surfaces of the retaining nut 1.4, are provided with a cadmium-free, olive-colored, possibly insulating dull surface. Similarly, the outwardly visible locking ring 2.3 of the plug 2, as well as the retention coupling nuts, for example 4.2 of the cable adapters 3 and 4, are provided with an olive-colored, possibly insulating dull, cadmium-free surface. The clamping nuts of the cable adapters 3 and 4, for example 4.3 on the cable adapter 4, can be provided with a conventional nickel surface. This optimizes the electrical conductivity relative to the shielding braiding. A heavy nickel surface is not necessary here since when the plug connection is finish assembled, the clamping nuts are respectively protected from optical and environmental influences by a pressed or shrunk on molded part, for example the molded part 5.

The dull surfaces of the components for which the electrical conductivity is not required, can be achieved by eloxidizing, lacquering or mechanical coating. Also conceivable is a polymeric or composite material. The olive-colored, dull surface must be resistant to the specific environmental influences. These component surfaces are non-conductive and hence are electrochemically neutral. Therefore, the plug compatability to conventional plugs of the respective standard is furthermore ensured. The chemical series of the conductive plug parts of the above-described plug connection remain unaltered relative to conventional embodiments since they are also nickel-plated below their cadmium layering.

Pursuant to one embodiment of the above-described plug connection, where the flange of the device socket is embodied as a four-holed mounting flange, both sides of the mounting flange, as contact and screw-on surfaces, are provided with a heavy nickel surface. If in this case the device socket is not to be installed in the housing, if necessary the shiny surface of the flange can be covered with olive-colored coverings.

The invention claimed is:

1. A plug connection for guiding a cable through an opening of a partition (W), comprising, a device socket (1) having a base body provided with a plug receiving portion (1.1) that is adapted to be inserted through the partition opening and is delimited by a mounting flange (1.3), wherein said device socket (1) is furthermore provided with a cable connector (1.2) disposed on a side of said mounting flange (1.3) remote from said plug receiving portion (1.1), and wherein said cable connector (1.2) is provided with a thread (1.21) adapted to be threadedly connected with a coupling nut of a cable adapter (3);

a plug (2) having a base body provided with an insertion body (2.1) that is adapted to be inserted into said device socket (1), wherein a locking ring (2.3) is rotatably disposed on said insertion body (2.1) and is adapted to cooperate with locking elements (1.12) disposed on said plug receiving portion (1) of said device socket (1), wherein said plug (2) is furthermore provided with a cable connector (2.2) provided with a thread (2.21) adapted to be threadedly connected with a coupling nut (4.2) of a cable adapter (4);

at least one cable adapter (3, 4) adapted to be connected to at least one of said device socket (1) and said plug (2) for a connection of a cable that is provided with a shielding braiding, wherein said at least one cable adapter (3, 4) has a base body (4.1) through which the cable is adapted to be guided and on which said coupling nut (4.2) is rotatably disposed, and wherein said at least one cable adapter (3, 4) has a connection end provided with securing means (4.13, 4.31) for said shielding braiding of a cable;

a cadmium-free, electrically conductive surface coating provided on at least an inner or outer continuous surface of: electrically conductive ones of the components of said plug connection, including at least said base bodies of said device socket (1) and said plug (2); at least a contact surface (1.31) of said mounting flange (1.3) relative to said partition (W); and possibly said base body (4.1) of said at least one cable adapter (3, 4);

interengaging teeth (1.22, 2.22, 4.11) as contact points between said base bodies of said device socket (1) and said plug (2) on the one hand, and said base bodies of respective ones of said cable adapters (3, 4) on the other hand, to ensure a continuous, electrically conductive contact;

a ground ring (2.11) to produce a contact point between said base bodies of said device socket (1) and said plug (2), wherein said ground ring (2.11) is disposed on one of said plug (2) or said device socket (1) and is provided with resilient tongues (2.12) that respectively rest on an inner our outer surface of said base body of the other of said device socket (1) or said base (2); and a dull, cadmium-free surface on outwardly visible ones of the components of said plug connection, including at least outer sides of said plug receiving portion (1.1) of said device socket (1), of said locking ring (2.3) of said plug (2), and possibly of said coupling nut (4.2) of said at least one cable adapter (3, 4), wherein said dull cadmium-free surface is resistant to environmental influences and is possibly electrically insulating.

2. A plug connection according to claim 1, wherein said electrically conductive surface coating is comprised of nickel.

3. A plug connection according to claim 2, wherein said electrically conductive surface coating is comprised of a nickel coating (heavy nickel) that is applied in several layers.

4. A plug connection according to claim 1, wherein said electrically conductive surface coating is comprised of tin.

5. A plug connection according to claim 1, wherein said electrically conductive surface coating is comprised of zinc.

6. A plug connection according to claim 1, wherein said electrically conductive surface coating is comprised of copper.

7. A plug connection according to claim 1, wherein said dull, cadmium-free surface that is resistant to environmental influences is an eloxidized metallic surface.

8. A plug connection according to claim 1, wherein said locking ring (2.3) of said plug (2) is comprised of polymeric material, or wherein said locking ring (2.3) of said plug (2) and said coupling nut (4.2) of said at least one cable adapter (3, 4) is comprised of polymeric material.

9. A plug connection according to claim 1, wherein said plug receiving portion (1.1) of said device socket (1) is provided with an external thread (1.11), wherein a retaining nut (1.4) is adapted to be threaded onto said external thread (1.11) in such a way that said partition (W) is clamped between said mounting flange (1.3) and said retaining nut (1.4), and wherein said retaining nut (1.4) is provided at least on outwardly facing surfaces thereof with a dull, cadmium-free surface that is resistant to environmental influences and is possibly electrically insulating.

10. A plug connection according to claim 9, wherein a side of said mounting flange (1.3) remote from said partition (W) is provided with a dull, cadmium-free surface that is resistant to environmental influences and is possibly electrically insulating.

11. A plug connection according to claim 9, wherein said retaining nut (1.4) is comprised of polymeric material.

12. A plug connection according to claim 1, wherein said mounting flange (1.3) is embodied as a four-holed mounting flange, and wherein opposite sides of said mounting flange are provided with said cadmium-free, electrically conductive surface coating.

13. A plug connection according to claim 1, wherein said connection end for the cable on said base body (4.1) of said cable adapter (4) is provided with an outer clamping surface (4.13) and an external thread (4.12), wherein a clamping nut (4.3) is adapted to be threaded onto said external thread (4.12) and has an inner conical clamping surface (4.31) for a fixation of the shielding braiding of the cable between said conical clamping surfaces (4.13, 4.31), and wherein said clamping nut (4.3) is provided with an electrically conductive surface coating at least on said conical clamping surface (4.31) thereof.

14. A plug connection according to claim 1, wherein said connection end of said base body (4.1) of said cable adapter (4) is adapted to be surrounded by an end of a molded part (5) that is adapted to guide the cable and that is provided with a retaining lip (5.1) adapted to engage in a receiving groove (4.14) on said base body (4.1) of said cable adapter (4).

15. A plug connection according to claim 1, wherein a sealing ring (4.4) is disposed on an end of said base body (4.1) of said cable adapter (4) that faces said plug (2) or said device socket (1) respectively.

16. A plug connection according to claim 1, wherein a dust cap is provided that is adapted to be threaded into said base body of said device socket (1) or onto said base body of said plug (2), wherein a surface of said dust cap is provided with said cadmium-free, electrically conductive surface coating, and wherein said outwardly visible parts of said dust cap are additionally provided with a dull cadmium-free surface that is resistant to environmental influences and is possibly electrically insulating.

* * * * *